United States Patent [19]

Dauvergne

[11] Patent Number: 4,643,133

[45] Date of Patent: Feb. 17, 1987

[54] CLUSTER BOILER

[76] Inventor: Hector A. Dauvergne, 419 Merle Ct., San Leandro, Calif. 94577

[21] Appl. No.: 711,673

[22] Filed: Mar. 14, 1985

[51] Int. Cl.[4] ..... F22B 21/00

[52] U.S. Cl. ..... 122/318; 110/234; 122/258; 122/259; 122/362; 122/420; 122/504

[58] Field of Search ..... 122/209 R, 211, 234, 122/258, 259, 305, 318, 319, 332, 360, 362, 420, 421, 444, 235 C, 235 F; 110/234

[56] References Cited

U.S. PATENT DOCUMENTS

| | | | |
|---|---|---|---|
| 797,329 | 8/1905 | Scherrer | 122/305 |
| 1,065,864 | 6/1913 | Decarie et al. | 110/234 X |
| 1,624,014 | 4/1927 | Schneider | 122/305 |
| 1,759,133 | 5/1930 | Nerad | 122/305 |
| 1,911,037 | 5/1933 | Prentice | 122/319 |
| 1,919,335 | 7/1933 | Kerr et al. | 122/318 |
| 1,930,566 | 10/1933 | Sanders | 122/235 F |
| 1,948,370 | 2/1934 | Coulson, Jr. | 122/318 |
| 3,926,130 | 12/1975 | Stloukal | 110/234 |
| 4,262,635 | 4/1981 | Dauvergne et al. | 122/235 C |

*Primary Examiner*—Albert J. Makay
*Assistant Examiner*—Steven E. Warner
*Attorney, Agent, or Firm*—Bielen and Peterson

[57] ABSTRACT

A cartridge boiler designed for use in multiples in a furnace, each cartridge boiler having a vertically oriented cylindrical drum top and bottom with hemispherical end caps, with a plurality of free-expansion boiler tubes having internal feed water supply tubes depending in a cluster through the bottom end cap. The supply tubes are gravity fed by an open feed water pan within the drum, the feed water supply being controlled by a boiler level monitoring device. The boilers are used in multiples to generate the steam required, the relative small size of individual cartridge boiler being designed to minimize fabrication costs by minimizing drum diameters, and maximize system performance by allowing select cartridge replacement without system shutdown.

12 Claims, 5 Drawing Figures

CLUSTER BOILER

BACKGROUND OF THE INVENTION

This invention relates to a cartridge boiler designed for use in multiples in a steam generation plant for power production, cogeneration or steam use. Small and medium size steam generating plants have long been used in factories and institutions for combusting waste products as well as fossil fuels for generation of steam. The generated steam was used primarily for heating and in many instances for processing of manufactured goods or agricultural products. With the design of small efficient steam turbines the combination of a steam generating system with a power production unit has economic merit. However, conventional designs of boilers used for steam heating are customerily low pressure systems ineffective for driving a steam turbine. The requirement for an inexpensive, medium pressure boiler that is safely operable with a variety of often low Btu fuels of inconsistent composition has led to the design of free-expansion tube arrangements and systems using multiple cartridge-like boiler units. While certain prior cartridge boiler designs are advantageous, they pose fabrication complications and do not represent the most effective designs for absolute minimum cost. The boiler system of the present invention is designed to generate steam suitable for electrical power generation from fuels that are of inconsistent composition and vary in thermal potential from 4000 Btu to 20,000 Btu. The boilers are designed primarily for use in multiples enabling flexibility in the design of a plant having a capacity suited for the desired use.

Naturally, however, the boiler as a stand alone unit will find use in situations where maximizing system efficiencies is not a primary goal.

SUMMARY OF THE INVENTION

The cartridge boiler of this invention is designed for use in multiples for example, in a double row in an elongated boiler furnace. The use of multiple boilers instead of a single boiler in a furnace has advantages in overall plant efficiency by permitting individual boilers to be removed for repair or cleaning with only a partial reduction in the plant output. Elimination of shutdown for boiler attention vastly increases the reliability of the plant and its suitability for power generation and industrial or agricultural processing where an unplanned shutdown could be disasterous, and a planned shutdown inconveniently expensive. Because of the multiplicity of boilers in a cluster boiler steam generating plant, each boiler must be inexpensive to fabricate. Key to economical cost construction is the relatively small diameter vertical drum design, the compact fire-tube cluster design, the flat plate tube connection scheme, and the circulating scheme, all of which allow moderate to high steam temperatures to be obtained with standard drum structures, but with a novel orientation and arrangement. Sizing is flexible with departures from a two inch, twenty foot fire-tube comparative standard, being design trades of performance and material costs. It is common knowledge that as drum sizes increase, costs rise exponentially to accommodate strength and material problems inherent in pressure vessels. The cartridge boiler is designed to minimize costs by minimizing drum sizes and fabrication complexities.

The cluster boiler is of a cartridge-type, having a compact cluster of free-expansion tubes connected to a single over-head drum. This design allows fuels of incosistent Btu value to be used in the furnace since each tube can expand freely according to its thermal exposure. Thermal differentials therefore place no expansion stresses common with double drum systems. The dependent, comb-like arrangement of the tubes allows the boiler to be easily removed from the furnace for servicing or repair. The vertical configuration of the drum minimizes the space necessary for each boiler permitting access to the drum for disconnection and ease in extracting the boiler from the furnace. The configuration permits the drum to be oriented on the outside top of the furnace with the tubes penetrating into the furnace. In this matter the boiler can be vertically hoisted, withdrawing the tubes from the furnace.

The cartridge concept allows furnace designers an opportunity to position tube clusters at various locations within the furnace according to the combustion and flow characteristics of the furnace. In this manner controlled pyrolysis designs with low emission characteristics can be effectively matched with steam production requirements in an extended chamber furnace.

Internally, the boiler utilizes an open, suspended feed-water distribution pan. A plurality of feed-water tubes are connected to the pan and extend down into the fire tubes. The feed-water tube includes perforation in its lower section to supply water to the fire tubes for transformation into steam. The fire tubes are inexpensive to fabricate and easily replaceable making them ideal for potentially corrosive furnace feedstock such as refuse derived fuel or blow-fired coal powders. These and other, features are described in greater detail in the detailed description of the preferred embodiments.

DETAILED DESCRIPTION OF THE PREFERRED EMBODIMENT

Figure 1:
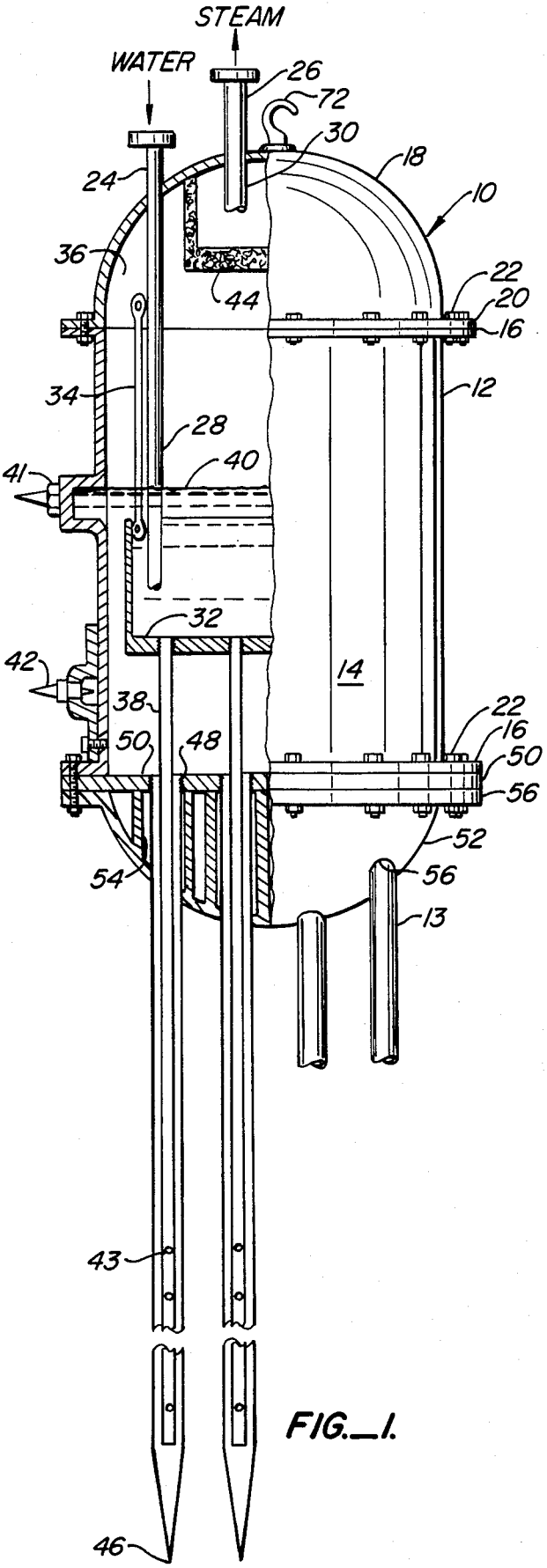
FIG. 1 is an elevational view partially in cross section of an individual cartridge boiler.
Figure 2:
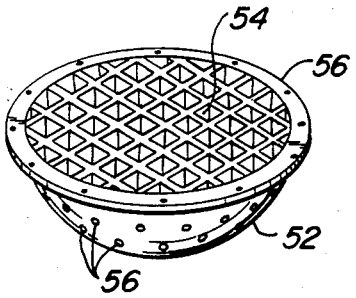
FIG. 2 is a perspective view of the lower hemispherical reinforcement cap of the boiler of FIG. 1.
Figure 3:
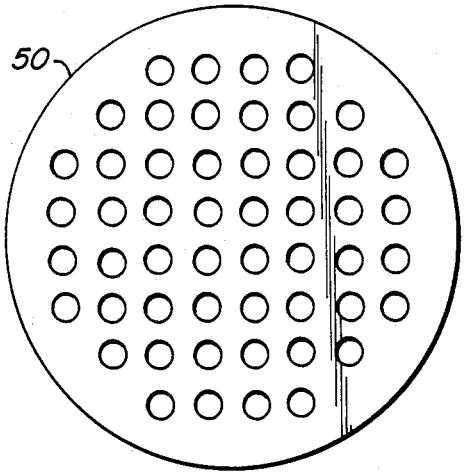
FIG. 3 is a top plan view of the fire tube mounting plate of the boiler of FIG. 1.

Referring to FIG. 1, a cartridge boiler, identified by the reference numeral 10 is shown. The boiler is constructed with a water drum 12 with depending free-expansion fire tubes 13. The drum 12 has a vertically oriented cylinder section 14 with top and bottom integral flanges 16. The drum is coupled to a top hemispherical pressure cap 18 with a perimeter flange 20 by a series of flange bolts 22. The top cap 18 has a water inlet 24 and a steam outlet 26 having tube extensions, 28 and 30 respectively, terminating within the interior of the boiler. The water tube extension 28 terminates within the perimeter of a open feedwater distribution pan 32 suspended within the boiler by straps 34 connected to the pan 36 and the inner wall 36 of the top cap 18. A plurality of feed water tubes 38 are threadably connected to the pan allowing the feed water tubes to be withdrawn with the cap from the fire tubes 13 on separation of the cap from the cylinder section 14 of the drum 12. The feedwater distribution pan 32 is located below the level of the drum water 40 such that the cooler feed water from the feed water extensions 28 is delivered to the feedwater tubes by the baffle effect of the pan and the natural downward flow by convection. In this manner a special circulating pump for the boiler water within the drum is eliminated. Water level is controlled by a sensor 41 which regulates the feed water supply by monitoring a conventional valve system. A low level warning sensor 42 senses a dangerously low water level and signals an alarm and/or activates a backup water supply to correct the situation.

The elongated feed water tubes have perforations 43 in the lower portions of the tubes to permit the feed water to flow directly to the fire tubes to insure a supply of water to the fire tubes. Without the perforations there is the potential flow can become restricted on a flash boiling of the supply from the bottom of the water tube during excessively hot conditions resulting in a back pressure surge.

The steam outlet extension 30 terminates in the upper portion of the top cap 18 and is encased by a steam pervious moisture separator 44. The moisture separation 44 removes the moisture entrained in the outward flowing steam the condensate dripping back to the boiler water.

The cluster of fire tubes 13 depending from the boiler drum are sized according to the design of the furnace and may extend twenty feet or more in length. The straight fire tubes have a distal end 46 that is pinched and welded, and a connecting end 48 that is threaded. In this manner, fabrication of the fire tubes is simple and can be accomplished in the field without special equipment. The connecting end 48 of the tubes is threaded into a flat, fire tube mounting plate 50, which comprises a diaphram-like seal for the boiler. The flat mounting plate 50 is convenient for mounting the tubes and easily fabricated, but its configuration is inadequate to withstand the pressures encountered in the boiler without deforming and possibly failing. Since the hemispherical shape is ideal for withstanding the high pressures of a boiler, a hemispherically configured pressure cap 52 with integrally cast cross ribs 54 is designed to couple to the cylinder section 14 of the drum 12 and reinforce the flat mounting plate 50. The pressure cap 52 has a flange 56, which couples to the flange 16 of the cylinder section 14 by a series of bolts 22, with the fire tube mounting plate sandwiched therebetween. Appropriate gaskets or seals (not shown) are also used.

The fire tubes extend down between the ribs 54 and through holes 56 in the hemispherical surface of the cap. Since it is the mounting plate 50 that acts as the sealing diaphram, the holes 56 through the cap allow for expansion of the tubes and do not perform any pressure sealing function. The cap, however, provides a shield to protect the fire tube connections from direct exposure to the furnace fire when the boilers are mounted over a furnace chamber 58 as shown in FIG. 5.

Figure 4:
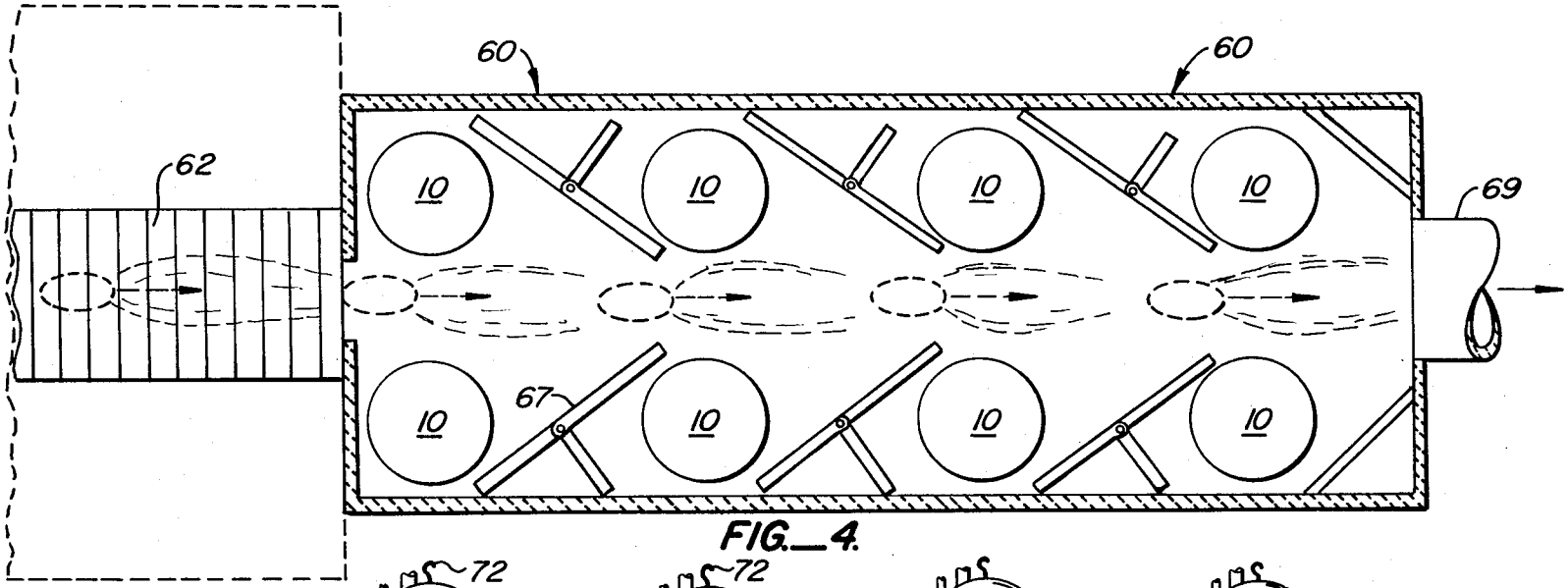
FIG. 4 is a schematic layout of a multiple boiler steam generating plant.
Figure 5:
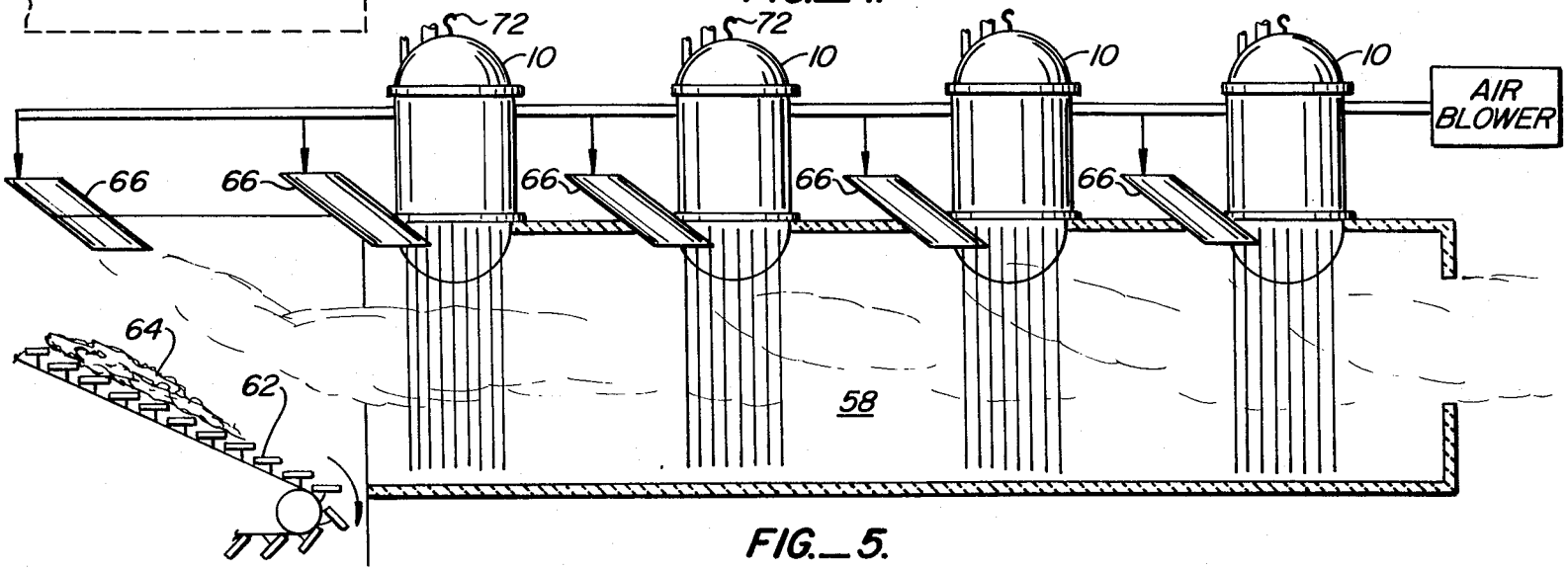
FIG. 5 is a side elevational view of the steam plant of FIG. 4.

Referring to FIGS. 4 and 5, the boilers 10 are illustrated schematically in conjunction with a controlled pyrolysis furnace 60 for a power plant. The furnace 60 has a rotary descending stoker grate 62 which feeds a solid fuel 64 to the entrance of the combustion chamber 58 where it is gasified by partial pyrolysis under oxygen lean conditions. Regulation of combustion is accomplished by flow control of air through air feed conduits 66 connected to a blower (not shown) which distribute the air supply over the grate 62 and along the length of the combustion chamber 58. Complete pyrolysis is delayed to maintain controlled furnace temperatures generally below the nitrogen fixation temperature of 2500° F. The combustion gases swirl through the tubes by action of baffles 67 oriented along the chamber 58. The baffles have sections 68 on pivots 69 for adjustments. The fully pyrolized gases are exhausted through an exhaust conduit 70. The exhaust conduit 70 may be connected to heat scavengers to heat the air supply and fuel before scrubbing and exhaust to atmosphere as is known in the art.

As shown in FIG. 5, the boilers are mounted on the top of the furnace with the tubes extending into the chamber 58. A hoist hook 72 helps an individual boiler to be removed and the opening covered without shutdown of the plant. The plant continues operating at corresponding reduction in capacity. The eight boilers shown are representative of a multiple boiler plant for generation of steam for use in a steam turbine power station. The plant can be elongated for additional boilers for increased capacity. Details of the plant are beyond the scope of this invention the plant being shown schematically to illustrate one configuration of multiple cluster boilers for a controlled pyrolysis furnace.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An improved cartridge type boiler system designed primarily for use in multiples according to the steam output capacity desired, comprising:

a boiler having a cylindrical configuration with the axis of the cylinder vertically disposed, wherein the boiler has an overhead water drum with depending fire tubes each fire tube having an internal feed water tube; and wherein the cylindrical configuration is elongated having a middle cylindrical section with top and bottom end caps, the bottom end cap including a connection plate and the depending fire tubes being coupled to the connection plate, wherein the connection plate is flat and the bottom end cap further includes a hemispherical reinforcement structure which interfaces and reinforces the flat connection plate.

2. The improved system of claim 1 wherein the fire tubes are threadably connected to the flat connection plate.

3. The improved system of claim 1 wherein the fire tubes have a distal end the end being pinched closed and welded.

4. The improved system of claim 1 wherein, a plurality of boilers are used in conjunction with an elongated furnace, the boilers being arranged in pairs along the length of the furnace.

5. The improved system of claim 4 wherein the furnace includes a series of baffles to improve the flow of combustion gases around the fire tubes.

6. The improved system of claim 1 wherein the boiler has feed-water tubes concentrically arranged in the fire tubes to supply water to the fire tubes.

7. The improved system of claim 6 wherein said feed-water tubes are coupled to a common open feed-water pan mounted in the water drum submersed in the water, the drum having a feed-water supply tube delivering feed-water from an external supply to the feed-water pan.

8. The improved system of claim 7 wherein the feed-water supply pan and connected feed-water tubes are connected to said top cap, said feed-water tubes being withdrawn on disconnection of the top end cap from the middle cylindrical section of the boiler.

9. An improved cartridge type boiler system designed for use in multiples according to the steam output capacity desired, comprising:

a plurality of boilers each having a cylindrical configuration with the axis of the cylinder vertically disposed, wherein the boilers each have an overhead water drum with vertically depending fire tubes each fire tube having an internal feed water tube concentrially arranged in the fire tube to supply water to the fire tube, wherein the boilers are proximally disposed and mounted on top of a furnace with tubes extending into the furnace each boiler being arranged for selective vertical removal from the furnace, wherein said feed-water tubes are coupled to a common open feed water pan mounted in the water drum submersed in the water, the drum having a feed-water supply to the feed-water pan, and wherein the drum has a middle cylindrical section with a top end cap, the feed-water supply pan and connected feed-water tubes being connected to said top end cap, said feed-water tubes being withdrawn on disconnection and removal of the top end cap from the middle cylindrical section of the boiler.

10. The improved system of claim 9 wherein the plurality of boilers are used in conjunction with an elongated furnace, the boilers being arranged in pairs along the length of the furnace.

11. The improved system of claim 10 wherein the furnace includes a series of baffles to improve the flow of combustion gases around the fire tubes.

12. An improved cartridge type boiler system designed primarily for use in multiples according to the steam output capacity desired, comprising:

a boiler having an overhead water drum with vertically depending fire tubes each fire tube having an internal feedwater tube concentrically arranged in the fire tube to supply water to the fire tube, wherein the water drum has a cylindrical configuration with the axis of the cylinder vertically disposed, the drum having a middle cylindrical section with a top end cap and the feed-water tubes coupled to a common open feed-water pan mounted in the water drum submersed in water, the drum having further a feed-water supply to the feed-water pan, wherein the feed-water supply pan and connected feed-water tubes are connected to said top cap, said feed-water tubes being withdrawn on disconnection and removal of the top end cap from the middle cylindrical section of the boiler.

* * * * *